US005263530A

United States Patent [19]

Colvin

[11] Patent Number: 5,263,530

[45] Date of Patent: Nov. 23, 1993

[54] METHOD OF MAKING A COMPOSITE CASTING

[75] Inventor: Gregory N. Colvin, Muskegon, Mich.

[73] Assignee: Howmet Corporation, Greenwich, Conn.

[21] Appl. No.: 758,908

[22] Filed: Sep. 11, 1991

[51] Int. Cl.[5] ..... B22D 19/02

[52] U.S. Cl. ..... 164/100; 164/98; 164/102; 164/76.1; 228/176; 228/235.1

[58] Field of Search ..... 164/102, 75, 100, 98, 164/91, 76.1; 228/176, 243

[56] References Cited

U.S. PATENT DOCUMENTS

| | | | |
|---|---|---|---|
| 1,057,713 | 4/1913 | Davies | 164/102 |
| 2,745,437 | 5/1956 | Comstock | 138/64 |
| 3,819,145 | 6/1974 | Huber et al. | 249/205 |
| 4,008,052 | 2/1977 | Vishnevsky et al. | 29/194 |
| 4,572,270 | 2/1986 | Funatani et al. | 164/97 |
| 4,592,120 | 6/1986 | Egan et al. | 164/100 |
| 4,889,177 | 12/1989 | Charbonnier et al. | 164/97 |

*Primary Examiner*—Mark Rosenbaum
*Assistant Examiner*—Erik R. Puknys
*Attorney, Agent, or Firm*—Flynn, Thiel, Boutell & Tanis

[57] ABSTRACT

A method of making a composite casting wherein a casting mold is provided for receiving a melt and a preformed metallic or intermetallic insert is positioned in the mold cavity. The preformed insert includes a working portion for incorporation in the casting and gas seal-forming means located at a region of the insert at least outboard of the insert portion. A melt is introduced into the mold about the insert and is then solidified to provide a composite casting having the insert working portion disposed in the solidified melt and as-cast gas seal regions located outboard of the insert working portion in the casting. The casting is then subjected to elevated temperature and isostatic gas pressure conditions wherein the as-cast gas seal regions are effective to inhibit gas penetration between the insert working portion and the solidified melt therearound so as to permit formation of a sound, void-free metallurgical bond therebetween. The hot isostatically pressed casting can then be trimmed to remove, if desired, those outboard portions containing the gas seal regions, leaving a finished casting having the insert working portion metallurgically bonded therein in a sound, void-free manner.

38 Claims, 4 Drawing Sheets

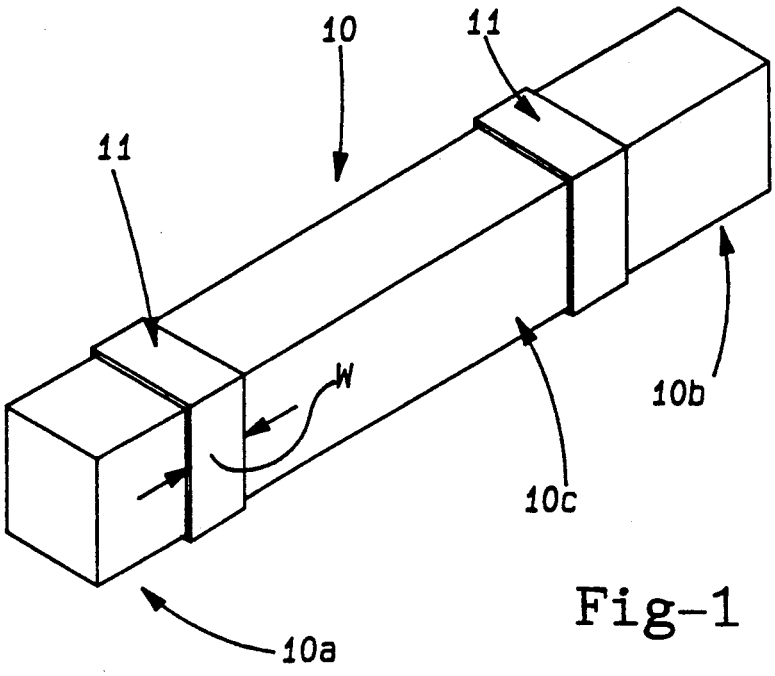
Fig-1
Fig-2
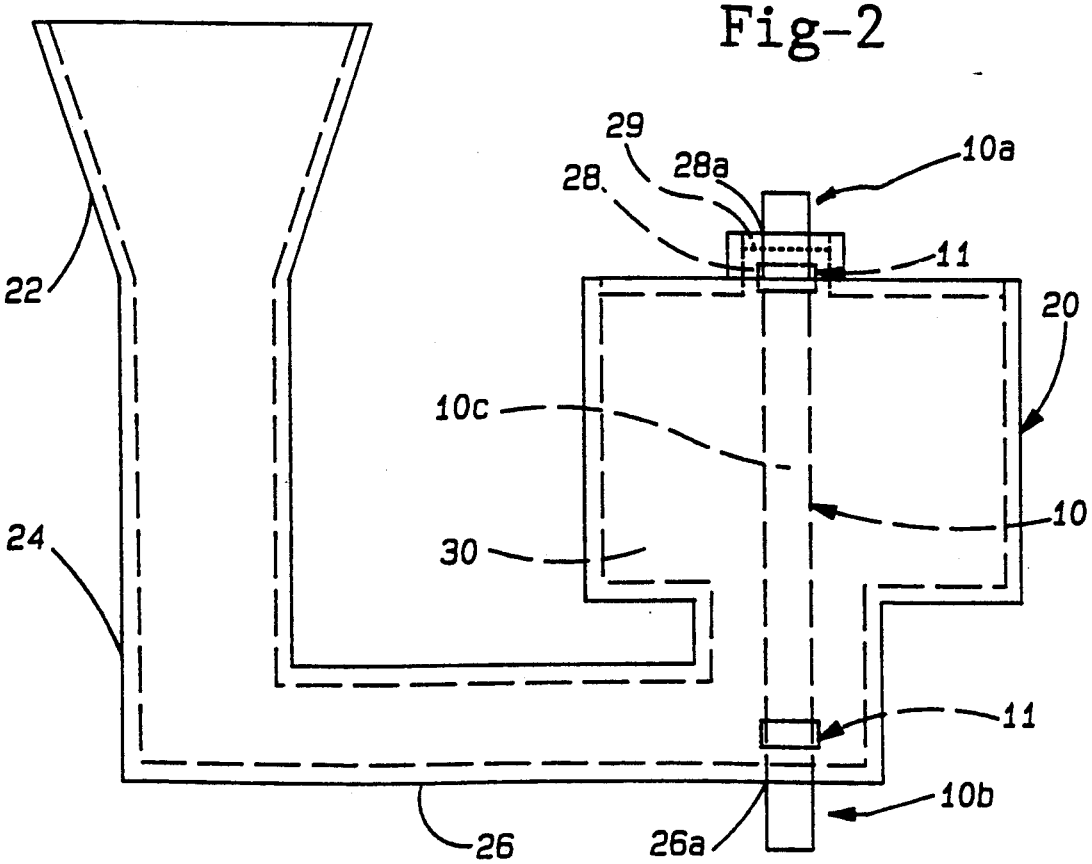

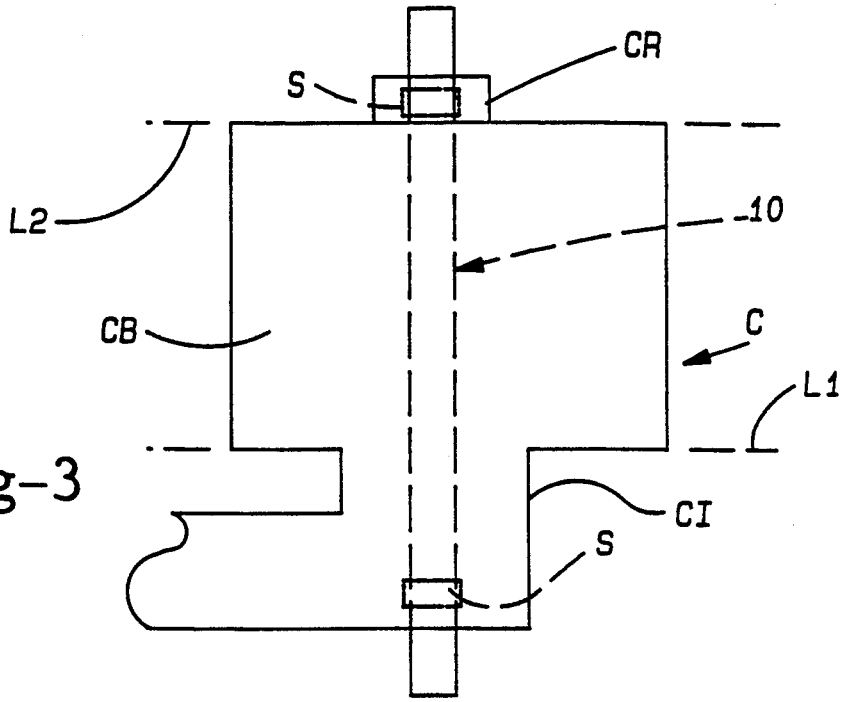
Fig-3
Fig-4
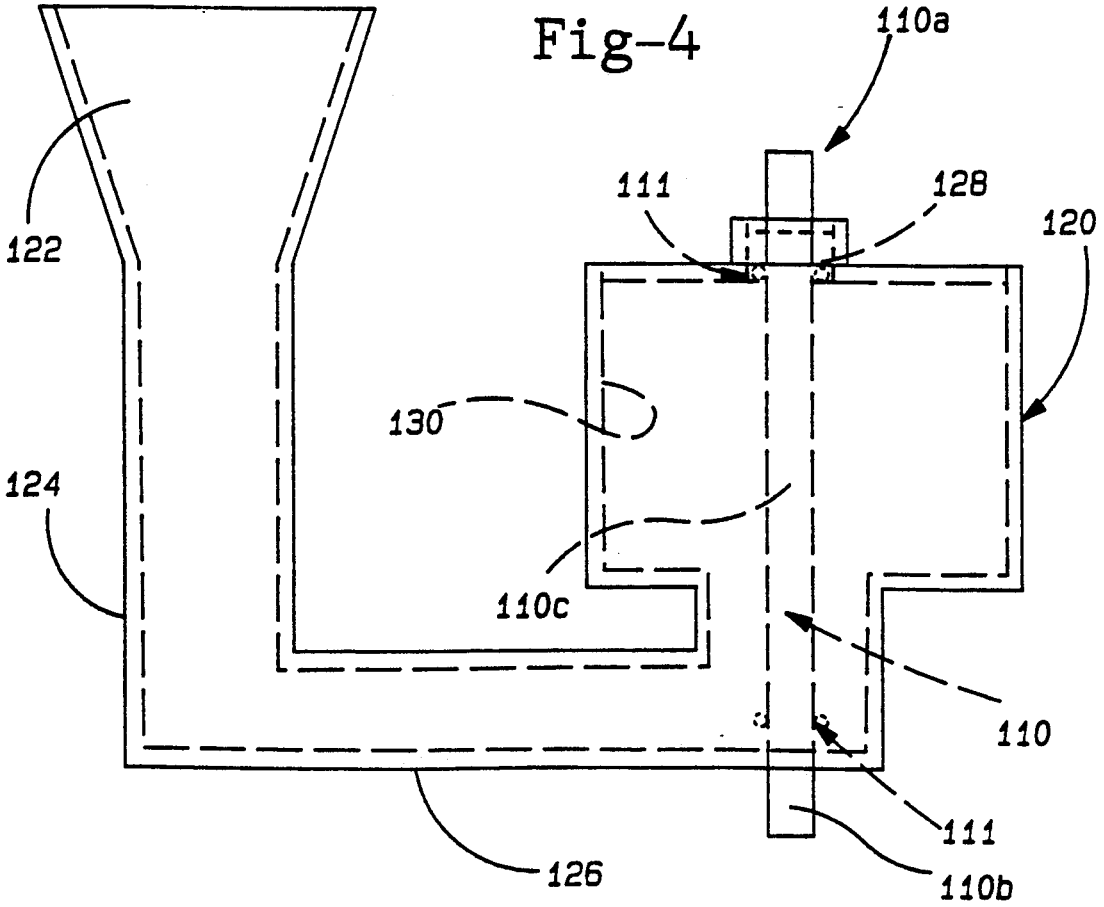

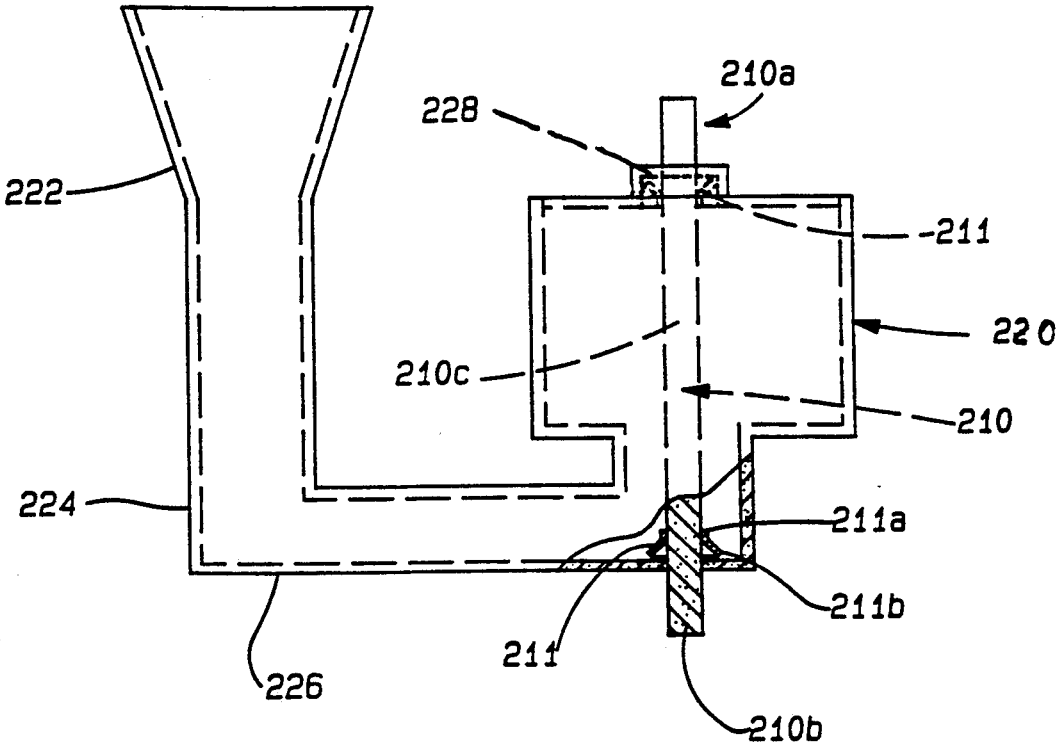
Fig-5
Fig-6
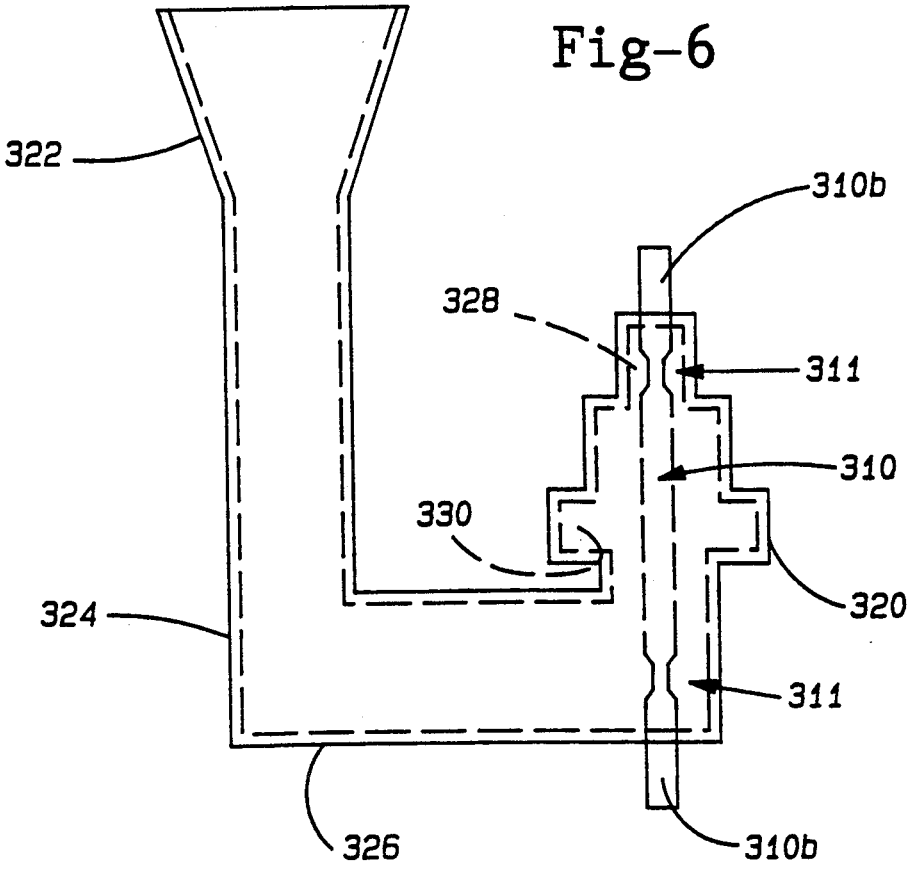

METHOD OF MAKING A COMPOSITE CASTING

FIELD OF THE INVENTION

The present invention relates to a method of making a composite casting having a preformed metallic or intermetallic insert, such as, for example, a reinforcement insert, soundly bonded in the casting.

BACKGROUND OF THE INVENTION

Components for aerospace, automotive and like service applications have been subjected to the ever increasing demand for improvement in one or more mechanical properties, such as tensile strength, ductility, high or low cycle fatigue life, resistance to impact damage, etc. while at the same time maintaining or reducing the weight of the component. To this end, the Charbonnier et al U.S. Pat. No. 4,889,177 describes a method of making a composite casting wherein a molten lightweight alloy, such as aluminum or magnesium, is countergravity cast into a gas permeable sand mold having a fibrous insert of high strength ceramic fibers positioned therein by metallic seats on the mold cavity wall so as to be incorporated into the casting upon solidification of the molten alloy.

The Funatani et al U.S. Pat. No. 4,572,270 describes a method of making a composite casting to this end wherein a mass of high strength reinforcing material, such as fibers, whiskers, or powder, is incorporated into a lightweight matrix metal, such as aluminum or magnesium, that is die cast around the reinforcing mass in a pressure chamber.

A technique commonly referred to as bicasting has been employed to improve one or more mechanical properties of superalloy castings used as aerospace components. Bicasting involves pouring molten metal into a mold cavity in which a preformed insert is positioned in a manner to augment one or more mechanical properties in a particular direction(s). The molten metal surrounds the insert and, upon solidification, yields a composite casting comprising the insert embedded in and hopefully soundly bonded with the solidified metal without contamination therebetween. However, as described in U.S. Pat. No. 4,008,052, attempts at practicing the bicasting process have experienced difficulty in consistently achieving a sound metallurgical bond between the insert and the metal solidified therearound without bond contamination. The inability to achieve on a reliable basis a sound, contamination-free bond between the insert and the cast metal has significantly limited and, with some material systems, eliminated use of bicast components in applications, such as aerospace components, where reliability of the component in service is paramount.

It is an object of the invention to provide an improved bicasting type of process for making a casting wherein a sound, uncontaminated, void-free, metallurgical bond is reliably produced between the preformed insert and the solidified metal therearound.

SUMMARY OF THE INVENTION

The present invention involves a method of making a casting, as well as the casting produced thereby, wherein a casting mold is provided for receiving a melt and a preformed metallic or intermetallic insert is positioned in the mold to contact the melt. The preformed insert includes a working portion for incorporation in the casting to be produced and gas seal-forming means on the insert at one or more locations to effectively isolate the working portion in the casting from gas penetration from exterior of the casting. A melt is introduced into the mold about the insert working portion in contact with the gas seal-forming means and then is solidified, providing a casting having the insert working portion disposed and isolated in the solidified melt by gas seal regions formed between the insert and the solidified melt. The method preferably involves the further step of subjecting the casting to elevated temperature and isostatic gas pressure conditions wherein the gas seal regions are effective to inhibit gas penetration between the insert working portion and the solidified melt therearound so as to permit formation of a sound, void-free, contamination-free metallurgical bond between the insert working portion and the cast melt.

In one embodiment of the invention, the gas seal-forming means comprise means disposed at regions of the insert located outboard of the working portion for forming a metallurgical bond between the insert and the cast melt effective to isolate the insert working portion in the casting.

In a particular embodiment of the invention, the gas seal-forming means is disposed on the insert proximate opposite end regions thereof outboard of an intermediate insert working portion. For example, one gas seal-forming means may be disposed on an insert end located in a lower ingate passage of the mold and another gas seal-forming means may be disposed on an opposite insert end located in an upper riser passage of the mold.

In another particular embodiment of the invention, each gas seal-forming means comprises a metallurgical bond-promoting material proximate each end region of the insert for facilitating metallurgical bonding to the cast melt. For example, each gas seal-forming means may comprise a melting point depressant material disposed about the periphery of the insert proximate the opposite end regions of the insert to facilitate metallurgical bonding to the cast melt. The melting point depressant material may extend along the length of the insert between the opposite ends in still another particular embodiment.

Each gas seal-forming means may alternately comprise a seal member, such as an annular metallic or intermetallic ring or foil, metallurgically attached to the insert and metallurgically bondable to the cast melt.

Each gas seal-forming means may further alternately comprise a recess formed about the periphery of the insert proximate the opposite insert end regions with each recess being configured to receive the melt introduced into the mold and form an intimate interface therewith effective to inhibit gas penetration at the interface.

In yet another embodiment of the invention, the preformed insert comprises a metallic or intermetallic material that corresponds in composition to the melt introduced into the mold cavity. The metallic or intermetallic material of the insert may include reinforcements, such as reinforcing filaments, therein.

DESCRIPTION OF THE DRAWINGS

FIG. 1 is a schematic perspective view of one embodiment of the invention wherein a preformed insert includes peripheral bands or stripes of a melting point depressant material applied thereon proximate opposite end regions thereof.

FIG. 2 is a schematic side elevational view of the ceramic shell mold with the preformed insert of FIG. 1 positioned in the mold cavity.

FIG. 3 is an elevational view of the casting in accordance with the invention.

FIG. 4 is a schematic side elevational view of a ceramic shell mold with the preformed insert of another embodiment of the invention positioned in the mold cavity.

FIG. 5 is a schematic side elevational view of a ceramic shell mold with the preformed insert of still another embodiment of the invention positioned in the mold cavity.

FIG. 6 is a schematic side elevational view of a ceramic shell mold with the preformed insert of a further embodiment of the invention positioned in the mold cavity.

DETAILED DESCRIPTION OF THE INVENTION

Figure 7:
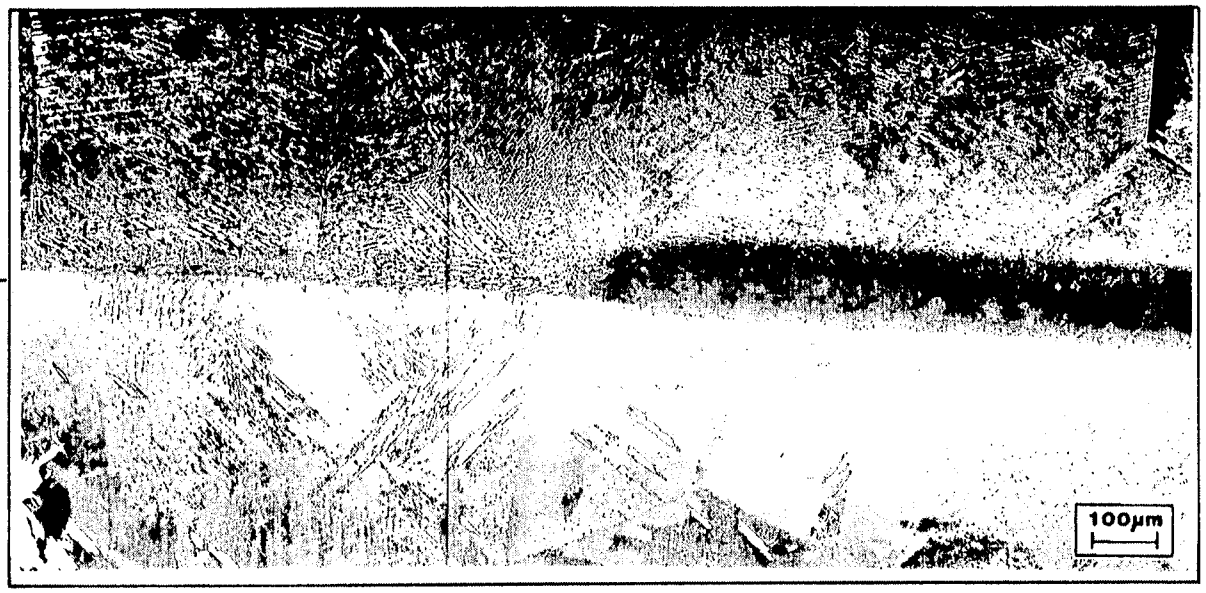
FIG. 7 is a photomicrograph of the bond region between the insert working portion and cast alloy in accordance with Example 1.

One embodiment of the invention is illustrated in FIG. 1 wherein a preformed insert 10 is shown having first and second gas seal-forming means in the form of first and second bands or stripes 11 of a suitable melting point depressant material applied as a coating or layer proximate the opposite ends or end regions 10*a*, 10*b* of the insert outboard of the intermediate working portion 10*c* of the insert. The working portion 10*c* of the insert 10 will be incorporated in the finished casting, whereas the gas seal-forming bands or stripes 11 will be incorporated in outboard regions of the casting that typically are subsequently removed (e.g., trimmed) as will become apparent, although the invention is not so limited.

Each stripe 11 is shown applied on the ends or end regions 10*a*, 10*b* so as to be disposed about the periphery thereof and to have a width w (e.g., 0.100 inch) in the direction of the longitudinal axis of the insert 10. Although the gas seal-forming means is described as comprising the bands or stripes 11 located outboard of the intermediate insert working portion 10*c* proximate the opposite ends 10*a*, 10*b*, the invention is not so limited and may be practiced with respect to a preformed insert 10 coated substantially entirely with the appropriate melting point depressant material, for example, as will be become evident from Example 1 below.

The melting point depressant material preferably comprises a metallic or intermetallic material that is compatible with the cast melt and the preformed insert in that the mechanical properties of the cast melt, preformed insert, and the bicasting ultimately produced are not adversely affected or degraded to an appreciable extent by the presence of the melting point depressant material. The composition and quantity of the melting point depressant material applied to the ends of the insert 10 are selected to achieve a sufficient reduction of the melting point across the insert/cast melt interface to promote formation of an as-cast gas seal metallurgical bond therebetween at the bands or stripes 11.

The composition and quantity of the melting point depressant material is selected in dependence on the compositions of the particular cast melt and the preformed insert to be employed. Illustrative of melting point depressant materials that may find use in producing a bicasting comprising a Ti-based cast melt and a Ti-based insert include, but are not limited to, $Ti_3Al$, TiAl, $Al_3Ti$, Ag, B, Si, and NiAl. Specific melting point depressant materials used to practice the invention are described in the Examples set forth herebelow.

The preformed insert 10 may comprise a metallic or intermetallic (e.g., titanium aluminide) material that is preformed by conventional fabrication operations, such as casting, powder metallurgy, plasma spraying, forging, etc., in the desired shape for the composite casting to be made. The preformed insert 10 may comprise a metallic or intermetallic material having a composition similar to or different from that of the melt to be cast therearound. Moreover, the preformed insert 10 may include reinforcements, such as reinforcing particulates, filaments and the like, therein. For example, the preformed insert 10 may comprise a metal matrix composite insert comprising a metallic or intermetallic matrix reinforced with suitable reinforcing filaments or particulates. The metal matrix composite may be sheathed with a material compatible with the melt to be cast so as to avoid unwanted reaction between the reinforcement and the cast melt.

Referring now to FIG. 2, the preformed insert 10 having the bands or stripes 11 of the melting point depressant material applied to the opposite ends or end regions 10*a*, 10*b* outboard of the insert working portion 10*c* is shown positioned in a refractory investment casting shell mold 20. The shell mold 20 includes a frustoconical funnel 22 into which a melt is poured from a suitable source, such as a ladle, a down sprue 24, and a laterally extending ingate or channel 26 that receives the melt from the down sprue 24. The ingate 26 is communicated to the mold cavity 30 so as to supply the melt thereto to fill the mold cavity 30 and the riser 28 thereabove. The shell mold 20 is fabricated in accordance with conventional shell mold practice wherein a fugitive (e.g., wax) pattern assembly having the configuration of the desired funnel 22, down sprue 24, ingate 26, and mold cavity 30 is dipped in a ceramic slurry, stuccoed or sanded with dry ceramic particulates, and then dried in repeated fashion to build up the shell mold 20 thereon. The pattern assembly is selectively removed from the shell mold 20 in conventional manner, such as by melting, dissolving or vaporization of the pattern.

The pattern assembly initially may be formed about the preformed insert 10 such that selective removal of the pattern leaves the insert 10 positioned in the mold cavity 30 with the opposite ends 10*a*, 10*b* extending out of an ingate opening 26*a* and riser opening 28*a*, respectively. Thereafter, the shell mold 20 is fired at elevated temperature to develop proper mold strength for casting while avoiding oxidizing or otherwise contaminating the surface of the insert and the gas seal-forming stripes 11. Alternatively, the preformed insert 10 may be positioned in the mold after firing depending on the mold firing temperature employed and the melting temperature of the melting point depressant material. The mold openings for the insert are formed in the mold prior to firing thereof.

The preformed insert 10 is located in the mold cavity 30 so that the insert working portion 10*c* is surrounded by the melt cast into the mold 20. In particular, the insert 10 is located in the mold 20 so that the insert ends or end regions 10*a*, 10*b* extend out of the upper riser opening 28*a* and out of the lower opening 26*a* formed in the ingate 26, FIG. 2. An integral or separate collar 29 of the mold 20 closes off the riser 28 and supports the insert end 10*a*. Suitable ceramic adhesive (not shown) typically is used to seal any space between the collar 29/insert end 10*a* and any space between the ingate 26/insert end 10*b* against melt leakage. The adhesive should not include any gaseous species that could be released during mold preheating prior to casting and contaminate the insert or mold. As is apparent from FIG. 2, the bands or stripes 11 of melting point depressant material proximate the opposite ends or end regions 10*a*, 10*b* of the insert 10 will be contacted by the melt introduced into the mold 20; namely by the melt in the ingate 26 and in the riser 28

After the preformed insert 10 is positioned in the mold cavity 30 and the mold is preheated to a desired casting temperature, a melt of a selected metallic or intermetallic (e.g., titanium aluminide) material is poured from a ladle or crucible (not shown) under vacuum into the mold funnel 22 and travels through the down sprue 24 and ingate 26 into the mold cavity 30 and riser 28. The insert working portion 10*c* and the bands or stripes 11 are thereby contacted and wetted by the melt and form an as-cast metallurgical bond. A composite bicasting C (FIG. 3) is produced upon melt solidification and includes the preformed insert 10 embedded and isolated in the main body CB of the bicasting.

During casting of the melt in the mold 20, the bands or stripes 11 of the melting point depressant material on the insert 10 promote "melt back" of the insert 10 (i.e., localized melting of the insert at the bands 11) when contacted and wetted by the melt to form an as-cast gas seal region S, illustrated schematically in FIG. 3, at each band or stripe 11. Each as-cast gas seal region S is substantially gas impermeable and is formed as a result of the "melt back" of the insert 10 and resultant metallurgical bonding between the cast melt and the insert 10 upon melt solidification. The metallurgical bonding effected at the as-cast gas seal regions S is sufficient to inhibit gas penetration between the cast melt and the insert working portion 10*c* during cool-down of the bicasting while still in the mold 20 and in a subsequent hot isostatic pressing operation of the composite bicasting C. The presence of the melting point depressant material at the bands or stripes 11 thus promotes sufficient metallurgical bonding between the cast melt and the insert 10 to form the as-cast gas seal regions S proximate the opposite ends or end regions 10*a*, 10*b* of the insert 10 and extending peripherally therearound. As is apparent, the gas seal regions S, in effect, isolate the insert working portion 10*c* as well as other portions of the insert 10 located inwardly of the gas seal regions S inside the solidified cast melt (i.e., inside the main body CB) from ambient gas penetration from exterior of the casting.

Following solidification of the melt, the mold 20 is removed by conventional techniques from the composite bicasting C of the invention. As shown in FIG. 3, the opposite ends or end regions 10*a*, 10*b* of the insert 10 extend beyond exterior surfaces of the composite bicasting C. However, the gas seal regions S are located in the cast ingate CI and the cast riser portions CR, respectively, of the composite bicasting C so as to isolate the working portion 10*c* of the insert 10 inside the main body CB thereof.

The bicasting C is then subjected to a hot isostatic pressing operation under elevated temperature/elevated isostatic pressure/time conditions effective to close any voids which may exist between the insert working portion 10*c* and the cast melt therearound as well as to insure that a sound metallurgical bond is achieved between the insert working portion and the cast melt therearound. The particular elevated temperature/elevated pressure/time conditions used will be tailored to the particular melt composition employed, the insert material employed as well as the size of the composite casting produced.

The as-cast, gas seal regions S proximate the opposite insert ends or end regions 10*a*, 10*b* have been found to be effective in inhibiting penetration of the pressurized isostatic pressing gas, such as argon, at the interface between the insert working portion 10*c* and the cast melt therearound during the hot isostatic pressing operation. In effect, the insert working portion 10*c* is embedded inside the cast main body CB such that the interface therebetween is not communicated to (is isolated from) the ambient atmosphere (as a result of the presence of the gas seal regions S outboard thereof). A sound, void-free, contamination-free metallurgical bond is achieved between the insert working portion 10*c* as well as other insert portions inboard of the gas seal regions S and the cast melt therearound when penetration of the isostatic pressing gas is effectively prevented in accordance with the invention.

The solidified melt CI and CR in the ingate 26 and the riser 28 can be removed from the composite bicasting C either prior to the or after the hot isostatic pressing operation so long as the gas seal regions S are retained on the bicasting C for the hot isostatic pressing operation. The hot isostatically pressed bicasting C can be trimmed as desired to produce the finished composite bicasting having the insert working portion 10*c* metallurgically bonded therein in a sound, void-free, contamination-free manner. For example, solidified melt CI and CR, including the gas seal regions S, can be trimmed from the casting following the pressing operation.

EXAMPLE 1

A ceramic shell mold 20 similar to that shown in FIG. 2 but having a stepwedge mold cavity 20 (see FIG. 6) was made in accordance with conventional shell mold practice. A preformed monolithic Ti-6Al-4-V plate insert 10 was positioned in the mold after mold firing and held in position in the mold cavity by the technique illustrated in FIG. 2. The preformed plate insert measured 4 inches in width, 6 inches in vertical length, and 1 inches in thickness and, prior to uniting with the mold, was coated completely with a substantially pure silver (Ag) gas seal-forming layer to a thickness of approximately 0.001 inch by an electrolytic coating process. A Ti-6Al-4V melt was cast under vacuum of less than 10 microns into the mold preheated to 600° F. and solidified in the mold cavity. The plate-shaped bicasting was separated from the shell mold and hot isostatically pressed at 1650° F. and 15 ksi argon gas pressure for 2 hours. Metallographic analysis of the bicasting indicated that a sound metallurgical bond was produced between the plate-like insert and the cast melt therearound as illustrated in FIG. 7. The gas seal-forming silver layer was effective in forming an as-cast gas seal between the plate insert and solidified melt to inhibit argon gas penetration between the insert and the cast melt therearound in the hot isostatic pressing operation.

Referring to FIGS. 4, 5 and 6, other embodiments of the invention are illustrated. In particular, FIG. 4 illustrates a ceramic mold 120 having a funnel 122, down sprue 124 and a preformed insert 110 positioned in the mold cavity 130. The insert includes first and second gas seal-forming means in the form of a peripherally extending metallic or intermetallic ring 111 proximate the opposite ends or end regions 110*a*, 110*b* of the insert 110 outboard of the insert working portion 110*c*. The lower ring 111 is disposed in ingate 126 while the upper ring 111 is disposed in the riser 128. Each ring 111 is welded or otherwise metallurgically attached to the respective end 110*a*, 110*b* to provide a gas tight connection therebetween. Rings 111 may have a cross-sectional diameter of about ⅛ inch in practicing the invention. The rings 111 preferably comprise a metallic or intermetallic material corresponding substantially in composition to the composition of the cast melt so as not to degrade the properties of the bicasting ultimately produced and to metallurgically bond (via at least partial melting thereof) with the cast melt sufficiently to form as-cast gas seal regions (not shown) at the rings 111 for inhibiting gas penetration at the interface between the insert working portion 110*c* and the cast melt during the subsequent hot isostatic pressing of the bicasting (which is produced by casting and solidifying the melt in the mold 120 as set forth for the first embodiment described above).

FIG. 5 illustrates a ceramic mold 220 having a funnel 222, down sprue 224 and a preformed insert 210 positioned in the mold cavity 230. The insert 210 includes first and second gas seal-forming means in the form of a peripherally extending metallic or intermetallic foil 211 proximate the opposite ends 210*a*, 210*b* of the insert 210 outboard of the working portion 210*c*. The lower foil 211 is disposed in the ingate 226 while the upper foil 211 is disposed in the riser 228. Each foil 211 includes a hub 211*a* welded or otherwise metallurgically attached proximate the respective end regions 210*a*, 210*b* to provide a gas tight connection therebetween and a diverging skirt 211*b*. A foil thickness of about 3–5 mils may be used in practicing the invention. The foils 211 preferably comprise a metallic or intermetallic material corresponding substantially in composition to the composition of the cast melt so as not to degrade the properties of the bicasting ultimately produced and to metallurgically bond (via at least partial melting thereof) with the cast melt sufficiently to form as-cast gas seal regions (not shown) at the foils 211 for inhibiting gas penetration to interfaces between the insert 210 and the cast melt during the subsequent hot isostatic pressing of the bicasting (which is produced by casting and solidifying the melt in the mold 220 as set forth for the first embodiment described above).

FIG. 6 illustrates a ceramic mold 320 having funnel 322, down sprue 324 and a preformed insert 310 positioned in the mold cavity 330. The insert 310 includes first and second gas seal-forming means in the form of a peripherally extending notch or slot 311 proximate the opposite end regions 310*a*, 310*b* of the insert 310 outboard of the working portion 310*c*. The lower slot 311 is disposed in the ingate 326 and the upper slot 311 is disposed in riser 328. Each notch or slot 311 is configured (e.g., axial length and depth of notch) to receive the melt introduced into the mold 320 and promote, at a minimum, formation of an intimate interface, preferably at least partial metallurgical bonding, between the insert 310 and the cast melt sufficient to form as-cast gas seal regions (not shown) at the notches or slots for inhibiting gas penetration to interfaces between the insert 310 and the cast melt during the subsequent hot isostatic pressing of the bicasting (which is produced by casting and solidifying the melt in the mold 320 as set forth for the first embodiment described above and as illustrated further in the following Example 2).

EXAMPLE 2

Figure 8:
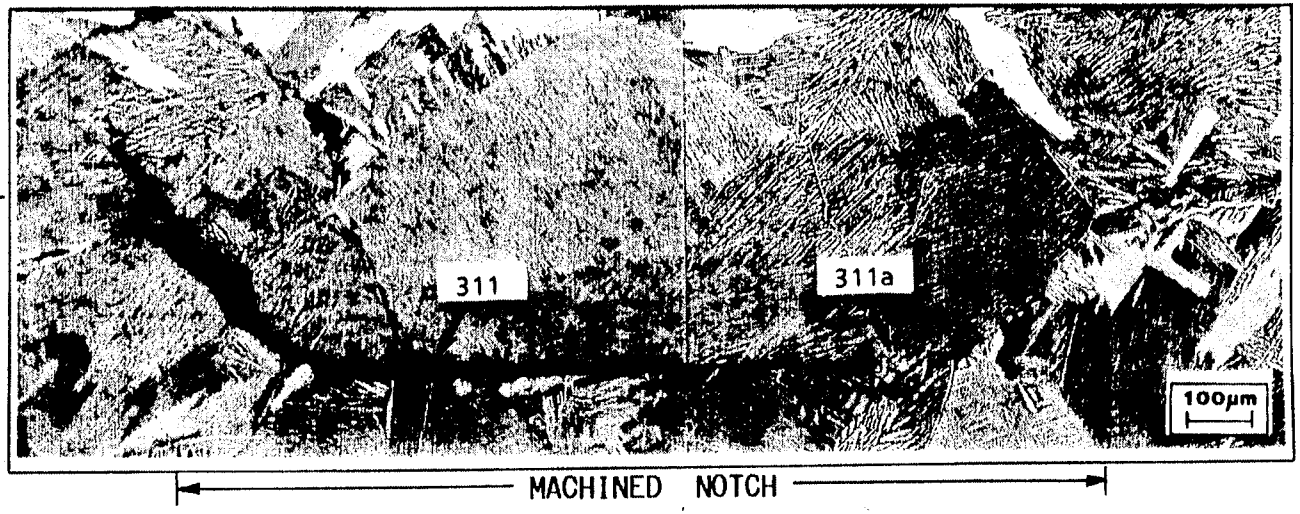
FIG. 8 is a photomicrograph of the bond region between the insert working portion and cast alloy in accordance with Example 2.

A ceramic shell mold 320 similar to that shown in FIG. 6 having a stepwedge mold cavity 330 was made in accordance with conventional shell mold practice. A preformed monolithic Ti-6Al-4V plate insert 10 was placed in the mold after mold firing and held in position in the mold cavity as shown in FIG. 6. The preformed plate insert measured 1 inches in width, 6 inches in vertical length, and 0.25 inches in thickness. The plate insert 310 was notched (dimensions evident from FIG. 8) about the periphery proximate opposite ends thereof in a manner similar to FIG. 6. A Ti6Al-4V melt was cast under vacuum of less than 10 microns into the mold preheated to 600° F. and solidified in the mold cavity. The bicasting was separated from the shell mold and hot isostatically pressed at 1650° F. and 15 ksi argon gas pressure for 2 hours. Metallographic analysis of the bicasting indicated that a sound metallurgical bond was produced between the plate-like insert and the cast melt therearound. A gas seal region was observed to form at the inner region 311*a* of each notch 311 as shown in FIG. 8.

From the above discussion, it is evident that the invention provides an improved bicasting type of process for making a composite casting wherein a sound, void-free metallurgical bond is reliably produced between the insert working portion and the cast melt therearound.

While the invention has been described in terms of specific embodiments thereof, it is not intended to be limited thereto but rather only to the extent set forth in the following claims.

I claim:

1. A method of making a casting having a preformed reinforcement insert therein, comprising the steps of:

a) providing a casting mold cavity for receiving a melt, b) positioning a preformed reinforcement insert in the mold cavity for contacting the melt introduced therein, said insert including an elongated intermediate working portion for incorporation inside the casting to reinforce said casting and gas seal-forming means on said insert at one or more locations to isolate the working portion in the casting from gas penetration from exterior thereof, c) introducing a melt into the mold cavity about the insert working portion and in contact with the gas seal-forming means, d) solidifying the melt in the mold cavity to form a casting comprising the solidified melt having the elongated intermediate insert working portion embedded inside the solidified melt to reinforce said casting an a gas seal region formed between the insert and the solidified melt at said one or more locations effective to inhibit gas penetration between the insert working portion and the solidified melt therearound, and e) subjecting the casting to elevated temperature and isostatic gas pressure conditions wherein said gas seal region is effective to inhibit gas penetration between the elongated intermediate insert working portion and the solidified melt therearound.

2. The method of claim 1 wherein the gas seal-forming means is disposed at a region of the insert located outboard of the insert working portion.

3. The method of claim 1 wherein the gas seal-forming means comprises means for forming an as-cast metallurgical bond between the insert and the solidified melt.

4. The method of claim 3 wherein the gas seal-forming means comprises a melting point depressant material to facilitate metallurgical bonding between the insert and melt.

5. The method of claim 3 wherein the gas seal-forming means comprises a metallic or intermetallic seal member metallurgically attached to the insert and metallurgically bondable to the melt.

6. The method of claim 1 wherein a gas seal-forming means is disposed on the insert proximate opposite end regions thereof.

7. The method of claim 6 wherein each gas seal-forming means comprises a region of melting point depressant material disposed about the periphery of the insert proximate said opposite end regions to facilitate metallurgical bonding to said melt.

8. The method of claim 6 wherein each gas seal-forming means comprises a metallic or intermetallic seal member metallurgically attached to the insert and metallurgically bondable to said melt.

9. The method of claim 8 wherein each seal member comprises a metallic or intermetallic ring metallurgically attached about the periphery of said insert.

10. The method of claim 8 wherein each seal member comprises a metallic or intermetallic foil metallurgically attached about the periphery of said insert.

11. The method of claim 6 wherein each gas seal-forming means comprises a recess formed about the periphery of the insert proximate said opposite end regions, said recess being configured to receive the melt introduced into the mold cavity and form an intimate interface therewith.

12. The method of claim 6 wherein a gas seal-forming means is disposed in an ingate passage of the mold that supplies the melt to a mold cavity of the mold and another gas seal forming means is disposed in a riser passage of the mold.

13. The method of claim 1 wherein the preformed insert comprises a metallic or intermetallic material that corresponds in composition to the melt introduced into the mold cavity.

14. The method of claim 13 wherein the metallic or intermetallic material of the insert includes reinforcements therein.

15. The method of clam 14 wherein the reinforcements comprise reinforcing filaments.

16. A method of making a casting having a preformed reinforcement insert therein, comprising:

a) providing a casting mold for receiving a melt, b) positioning a preformed metallic or intermetallic reinforcement insert in the mold to contact the melt, said insert including an intermediate working portion for incorporation in the casting and gas seal-forming means located proximate opposite end regions of said insert outboard of the insert working portion, c) introducing a melt into the mold about the insert working portion and in contact with the gas seal-forming means, d) solidifying the melt in the mold cavity to provide a casting comprising the solidified melt having the insert working portion disposed therein and gas seal regions formed between the insert and solidified melt outboard of the insert working portion and effective to inhibit gas penetration between the insert working portion and the solidified melt therearound, and e) subjecting the casting to elevated temperature and isostatic gas pressure conditions wherein the gas seal regions are effective to inhibit gas penetration between the insert working portion and the solidified melt therearound so as to permit metallurgical bonding and closure of any residual voids between said insert working portion and solidified melt by the elevated temperature and pressure conditions.

17. The method of claim 16 wherein each gas seal-forming means comprises a region of melting point depressant material disposed about the periphery of the insert proximate said opposite end regions to form a gas seal metallurgical bond region proximate said opposite ends.

18. The method of claim 16 wherein each gas seal-forming means comprises a metallic or intermetallic seal member disposed about the periphery of the insert proximate said opposite end regions and metallurgically bonded to the melt.

19. The method of claim 16 wherein each seal member comprises a metallic or intermetallic ring metallurgically attached about the periphery of said insert.

20. The method of claim 19 wherein each seal member comprises a metallic or intermetallic foil metallurgically attached about the periphery of said insert.

21. The method of claim 16 wherein the preformed insert comprises a metallic or intermetallic material that corresponds in composition to the melt introduced into the mold cavity.

22. The method of clam 21 wherein the metallic or intermetallic material of the insert includes reinforcements therein.

23. The method of clam 22 wherein the reinforcements comprise reinforcing filaments.

24. The method of claim 16 wherein a gas seal-forming means is disposed in an ingate passage of the mold that supplies the melt to the mold cavity of the mold and another gas seal forming means is disposed in a riser passage of the mold.

25. A method of making a casting having a preformed insert therein, comprising the steps of:

a) providing a casting mold for receiving a melt, b) positioning a preformed insert in the mold for contacting the melt introduced therein, said insert including a working portion for incorporation in the casting and gas seal-forming means disposed on the insert proximate opposite end regions thereof to isolate the working portion in the casting from gas penetration from exterior thereof, c) introducing a melt into the mold about the insert working portion and in contact with the gas-seal forming means, and d) solidifying the melt in the mold to form a casting comprising the solidified melt having the insert working portion disposed therein and a gas seal region formed between the insert and the solidified melt at said opposite end regions effective to inhibit gas penetration between the insert working portion and the solidified melt therearound.

26. The method of claim 25 wherein each gas seal-forming means comprises a region of melting point depressant material disposed about the periphery of the insert proximate said opposite end regions to facilitate metallurgical bonding to said melt.

27. The method of claim 25 wherein each gas seal-forming means comprises a metallic or intermetallic seal member metallurgically attached t the insert and metallurgically bondable to said melt.

28. The method of claim 27 wherein each seal member comprises a metallic or intermetallic ring metallurgically attached about the periphery of said insert.

29. The method of claim 27 wherein each seal member comprises a metallic or intermetallic foil metallurgically attached about the periphery of said insert.

30. The method of claim 25 wherein each gas seal-forming means comprises a recess formed about the periphery of the insert proximate said opposite end regions, said recess being configured to receive the melt introduced into the mold cavity and form an intimate interface therewith.

31. A method of making a casting having a preformed insert therein, comprising the steps of:

a) providing a casting mold cavity for receiving a melt, b) positioning a preformed insert in the mold cavity for contacting the melt introduced therein, said insert including an elongated intermediate working portion for incorporation inside the casting and gas seal-forming means on said insert at one or more locations to isolate the working portion in the casting from gas penetration from exterior thereof, said insert comprising a metallic or intermetallic material that corresponds substantially in composition to said melt and comprising reinforcing filaments in said material, c) introducing a melt into the cavity about the insert working portion and in contact with the gas seal-forming means, d) solidifying the melt in the mold cavity to form a casting comprising the solidified melt having the elongated intermediate insert working portion embedded inside the solidified melt to reinforce said casting and a gas seal region formed between the insert and the solidified melt at said one or more locations effective to inhibit gas penetration between the insert working portion and the solidified melt therearound, and e) subjecting the casting to elevated temperature and isostatic gas pressure conditions wherein said gas seal region is effective to inhibit gas penetration between the elongated intermediate insert working portion and the solidified melt therearound.

32. A method of making a casting comprising titanium having a preformed reinforcement insert therein, comprising the steps of:

a) providing a casting mold cavity for receiving a melt comprising titanium, b) positioning a preformed reinforcement insert in the mold cavity for contacting the melt introduced therein, said insert including an elongated intermediate working portion for incorporation inside the casting to reinforce said casting and gas seal-forming means on said insert at one or more locations to isolate the working portion in the casting from gas penetration from exterior thereof, c) introducing a melt comprising titanium into the mold cavity about the insert working portion and in contact with the gas seal-forming means, d) solidifying the melt in the mold cavity to form a casting comprising the solidified melt having the elongated intermediate insert working portion embedded inside the solidified melt to reinforce said casting and a gas seal region formed between the insert and the solidified melt at said one or more locations effective to inhibit gas penetration between the insert working portion and the solidified melt therearound, and e) subjecting the casting to elevated temperature and isostatic gas pressure conditions wherein said gas seal region is effective to inhibit gas penetration between the elongated intermediate insert working portion and the solidified melt therearound.

33. A method of making a casting having a preformed insert therein, comprising the steps of:

a) providing a casting mold cavity for receiving a melt, b) positioning a preformed insert in the mold cavity for contacting the melt introduced therein, said insert including an elongated intermediate working portion for incorporation inside the casting and gas seal-forming means disposed on the insert proximate opposite end regions thereof to isolate the intermediate working portion in the casting from gas penetration from exterior thereof, c) introducing a melt into the mold cavity about the insert working portion and in contact with the gas seal-forming means, and d) solidifying the melt in the mold cavity to form a casting comprising the solidified melt having the intermediate insert working portion embedded inside the solidified melt to reinforce said casting and a gas seal region formed between the insert and the solidified melt at said opposite end regions effective to inhibit gas penetration between the intermediate insert working portion and the solidified melt therearound.

34. The method of claim 33 wherein each gas seal-forming means comprises a region of melting point depressant material disposed about the periphery of the insert proximate said opposite end regions to facilitate metallurgical bonding to said melt.

35. The method of claim 33 wherein each gas seal-forming means comprises a metallic or intermetallic seal member metallurgically attached to the insert and metallurgically bondable to said melt.

36. The method of claim 35 wherein each seal member comprises a metallic or intermetallic ring metallurgically attached about the periphery of said insert.

37. The method of claim 35 wherein each seal member comprises a metallic or intermetallic foil metallurgically attached about the periphery of said inset.

38. The method of claim 33 wherein each gas seal-forming means comprises a recess formed about the periphery of the inset proximate said opposite end regions, said recess being configured to receive the metal introduced into the mold cavity and form an intimate interface therewith.

* * * * *